US010849445B2

(12) United States Patent
Anthony et al.

(10) Patent No.: US 10,849,445 B2
(45) Date of Patent: Dec. 1, 2020

(54) BEVERAGE CONTAINER

(71) Applicant: UPSLOPE BRANDS, INC., Downers Grove, IL (US)

(72) Inventors: John J. Anthony, Downers Grove, IL (US); Brett Moody, Chicago, IL (US); James Orrico, Evanston, IL (US)

(73) Assignee: Upslope Brands, Inc., Downers Grove, IL (US)

( * ) Notice: Subject to any disclaimer, the term of this patent is extended or adjusted under 35 U.S.C. 154(b) by 199 days.

(21) Appl. No.: 16/207,913

(22) Filed: Dec. 3, 2018

(65) Prior Publication Data

US 2019/0335929 A1 Nov. 7, 2019

Related U.S. Application Data

(60) Provisional application No. 62/665,267, filed on May 1, 2018.

(51) Int. Cl.

| | |
|---|---|
| ***A47G 19/22*** | (2006.01) |
| ***B65D 41/04*** | (2006.01) |
| ***B65D 25/04*** | (2006.01) |
| ***B65D 47/20*** | (2006.01) |
| *B65D 47/08* | (2006.01) |
| *B65D 55/02* | (2006.01) |

(52) U.S. Cl.

CPC ..... *A47G 19/2272* (2013.01); *B65D 25/04* (2013.01); *B65D 41/0414* (2013.01); *B65D 41/0485* (2013.01); *B65D 47/2056* (2013.01); *B65D 41/0471* (2013.01); *B65D 47/08* (2013.01); *B65D 55/02* (2013.01); *B65D 2547/063* (2013.01)

(58) Field of Classification Search

CPC ..... A47G 19/2272; B65D 41/0414; B65D 41/0485; B65D 41/0471; B65D 47/08; B65D 47/2056; B65D 2547/063

USPC ..... 220/714

See application file for complete search history.

(56) References Cited

U.S. PATENT DOCUMENTS

| | | | |
|---|---|---|---|
| 5,727,714 | A | 3/1998 | Fawcett |
| 6,675,998 | B2 | 1/2004 | Forsman et al. |
| D509,408 | S | 9/2005 | Ward et al. |
| D515,357 | S | 2/2006 | Ward et al. |
| 7,063,243 | B2 | 6/2006 | Forsman et al. |
| D524,107 | S | 7/2006 | El-Saden et al. |
| 7,740,153 | B2 | 6/2010 | Gustafson |
| 7,997,442 | B2 | 8/2011 | Pinelli |

(Continued)

FOREIGN PATENT DOCUMENTS

| | | |
|---|---|---|
| BR | 102015021054 A2 | 3/2017 |

*Primary Examiner* — King M Chu

(74) *Attorney, Agent, or Firm* — Brooks Kushman P.C.

(57) ABSTRACT

A beverage container includes a first vessel, a second vessel, a cap assembly, a first conduit, and a second conduit. The first and second vessels are vertically stacked and define first and second internal cavities, respectively. The first vessel is disposed above the second vessel. A cap assembly is secured to a top of the first vessel. The cap assembly defines first, second, and third orifices. The first orifice establishes fluid communication with the first internal cavity. The first conduit establishes fluid communication between the second internal cavity and the second orifice. The second conduit establishes fluid communication between the second internal cavity and the third orifice.

15 Claims, 8 Drawing Sheets

(56) References Cited

U.S. PATENT DOCUMENTS

| | | | |
|---|---|---|---|
| 8,191,727 | B2 | 6/2012 | Davies et al. |
| 8,360,267 | B1 | 1/2013 | Chion et al. |
| 8,381,935 | B1 | 2/2013 | Buck |
| 8,469,226 | B2 | 6/2013 | Davies et al. |
| 8,590,730 | B2 | 11/2013 | Buck |
| 8,590,731 | B2 | 11/2013 | Pinelli |
| 8,596,491 | B2 | 12/2013 | Buck |
| 8,695,845 | B2 | 4/2014 | Buck |
| 8,708,181 | B2 | 4/2014 | Buck |
| 8,714,393 | B2 | 5/2014 | Buck |
| 8,863,979 | B2 | 10/2014 | El-Saden et al. |
| 8,870,010 | B2 | 10/2014 | Buck |
| 8,919,592 | B2 | 12/2014 | Buck |
| 9,095,233 | B2 | 8/2015 | Pinelli |
| 9,102,439 | B2 | 8/2015 | Kemper et al. |
| 9,120,598 | B2 | 9/2015 | Meyers et al. |
| 9,216,843 | B2 | 12/2015 | Sorensen et al. |
| 9,260,228 | B2 | 2/2016 | Buck |
| 9,492,024 | B2 | 11/2016 | Sorensen et al. |
| 9,622,605 | B2 | 4/2017 | Buck |
| 9,708,107 | B2 | 7/2017 | El-Saden et al. |
| 9,782,028 | B2 | 10/2017 | Davies et al. |
| 2005/0247719 | A1 | 11/2005 | Loging |
| 2011/0127258 | A1* | 6/2011 | Chodosh ..... A47G 19/2272 220/4.27 |
| 2011/0253745 | A1 | 10/2011 | Mainville et al. |
| 2013/0037510 | A1* | 2/2013 | Tamarit Rios ..... B65D 47/243 215/259 |
| 2015/0201776 | A1 | 7/2015 | Elsaden et al. |
| 2015/0360804 | A1 | 12/2015 | Ayeni |
| 2016/0114947 | A1 | 4/2016 | Buck |
| 2016/0150902 | A1 | 6/2016 | Dokhanian et al. |
| 2016/0249755 | A1 | 9/2016 | Sorensen et al. |
| 2017/0113837 | A1 | 4/2017 | Szymanksi et al. |
| 2017/0127859 | A1 | 5/2017 | Hornung et al. |
| 2017/0181556 | A1 | 6/2017 | Lai |
| 2017/0362001 | A1 | 12/2017 | Buck |

* cited by examiner

BEVERAGE CONTAINER

CROSS-REFERENCE TO RELATED APPLICATIONS

This application claims the benefit of U.S. provisional application No. 62/665,267 filed on May 1, 2018, the disclosure of which is hereby incorporated in its entirety by reference herein.

TECHNICAL FIELD

The present disclosure relates to containers that are configured to store and dispense water or other beverages.

BACKGROUND

Refillable beverage containers may be configured to contain and insulate hot and/or cold beverages while also providing access to the contents of the container for consumption by a user of the beverage container.

SUMMARY

A beverage container includes a first vessel, a second vessel, a cap assembly, a first tube, and a second tube. The first vessel defines a first internal cavity. The second vessel is secured to the first vessel and defines a second internal cavity. The cap assembly defines a first orifice configured to dispense liquid, a second orifice configured to dispense liquid, and a third orifice configured to vent gas. The cap assembly is secured to an opposing side of the first vessel relative to the second vessel. The first orifice establishes fluid communication with the first internal cavity. The first tube establishes fluid communication between the second internal cavity and the second orifice. The second tube establishes fluid communication between the second internal cavity and the third orifice.

A beverage container includes a first vessel, a second vessel, a cap assembly, a first conduit, and a second conduit. The first and second vessels are secured to each other. The first and second vessels define first and second cavities, respectively. The first cavity is partitioned from the second cavity. The cap assembly defines first, second, and third outlets. The cap assembly is secured to an opposing side of the first vessel relative to the second vessel. The first outlet establishes fluid communication with the first internal cavity. The first and second conduits extend from the second vessel to the cap assembly along an exterior of the first vessel. The first conduit establishes fluid communication between the second cavity and the second outlet. The second conduit establishes fluid communication between the second cavity and the third outlet.

A beverage container includes a first vessel, a second vessel, a cap assembly, a first conduit, and a second conduit. The first and second vessels are vertically stacked and define first and second internal cavities, respectively. The first vessel is disposed above the second vessel. A cap assembly is secured to a top of the first vessel. The cap assembly defines first, second, and third orifices. The first orifice establishes fluid communication with the first internal cavity. The first conduit establishes fluid communication between the second internal cavity and the second orifice. The second conduit establishes fluid communication between the second internal cavity and the third orifice.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
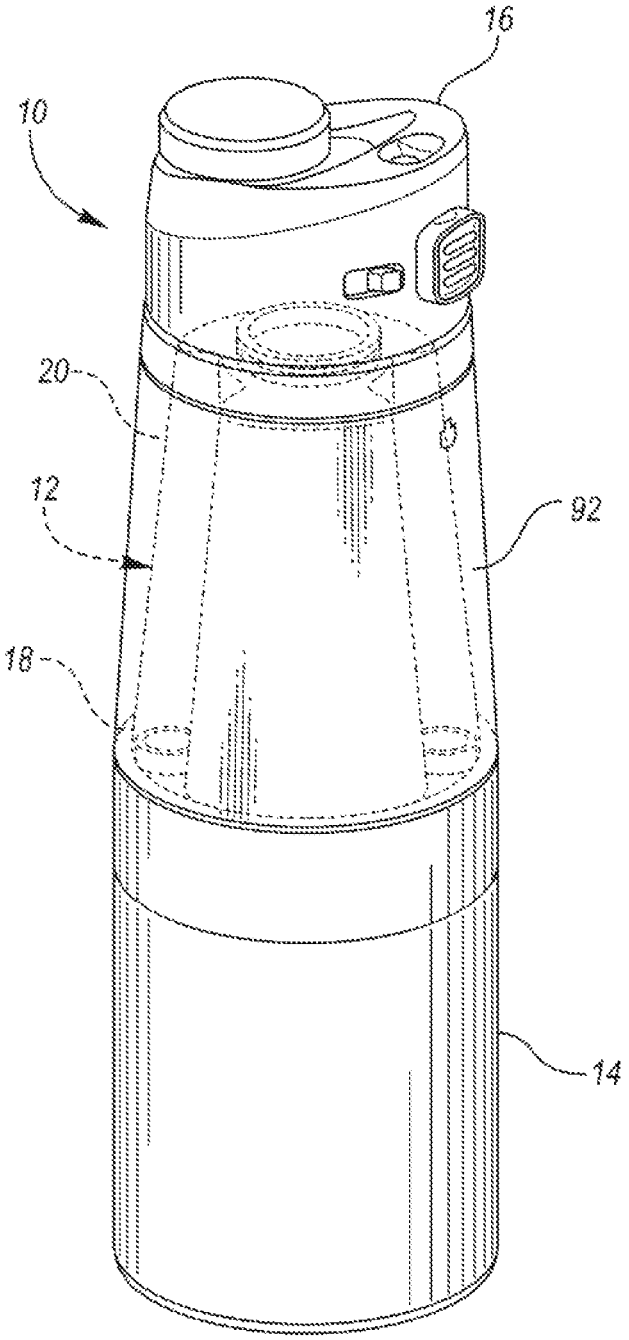
FIG. 1 is a perspective view of an exemplary beverage container.

Referring to FIG. 1, a perspective view of a beverage container 10 is illustrated. The beverage container 10 includes a first vessel 12, a second vessel 14, and a cap assembly 16. The first vessel 12 may be cylindrical or may taper inward as one or more walls of the first vessel 12 extend from a first end 18 to a second end 20 such that the first end 18 is wider than the second end 20. The one or more walls of the first vessel 12 may form a cylindrical, conical, or frusto-conical shape. The second vessel 14 may be secured to the first vessel 12. More specifically, the second vessel 14 may be secured to the first end 18 of the first vessel 12. A threaded connection (i.e., a threaded outer surface and a tapped orifice) may be utilized to secure the second vessel 14 to the first end 18 of the first vessel 12. However, other types of connections, such as clamps or clips, may be utilized to secure the second vessel 14 to the first vessel 12. The cap assembly 16 may be secured to the opposing side of the first vessel 12 relative to the second vessel 14 (i.e., the top or the second end 20 of the first vessel 12). The first vessel 12, second vessel 14, and cap assembly 16 may be vertically stacked. For example, the first vessel 12 may be secured to and stacked on top of the second vessel 14, and the cap assembly 16 may be secured to and stacked on top of the first vessel 12.

Figure 2A:
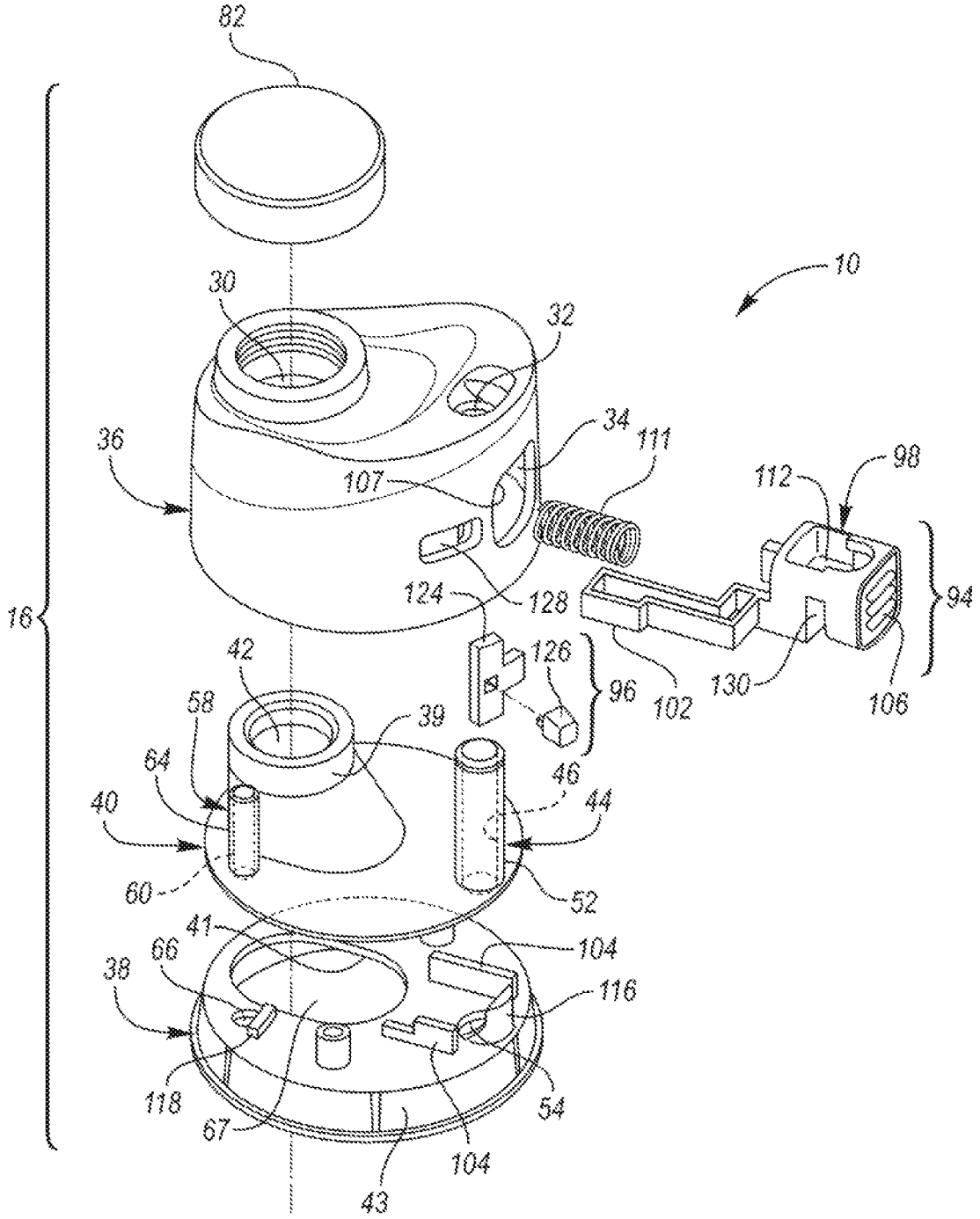
FIGS. 2A-2B are an exploded view of the exemplary beverage container.
Figure 2B:
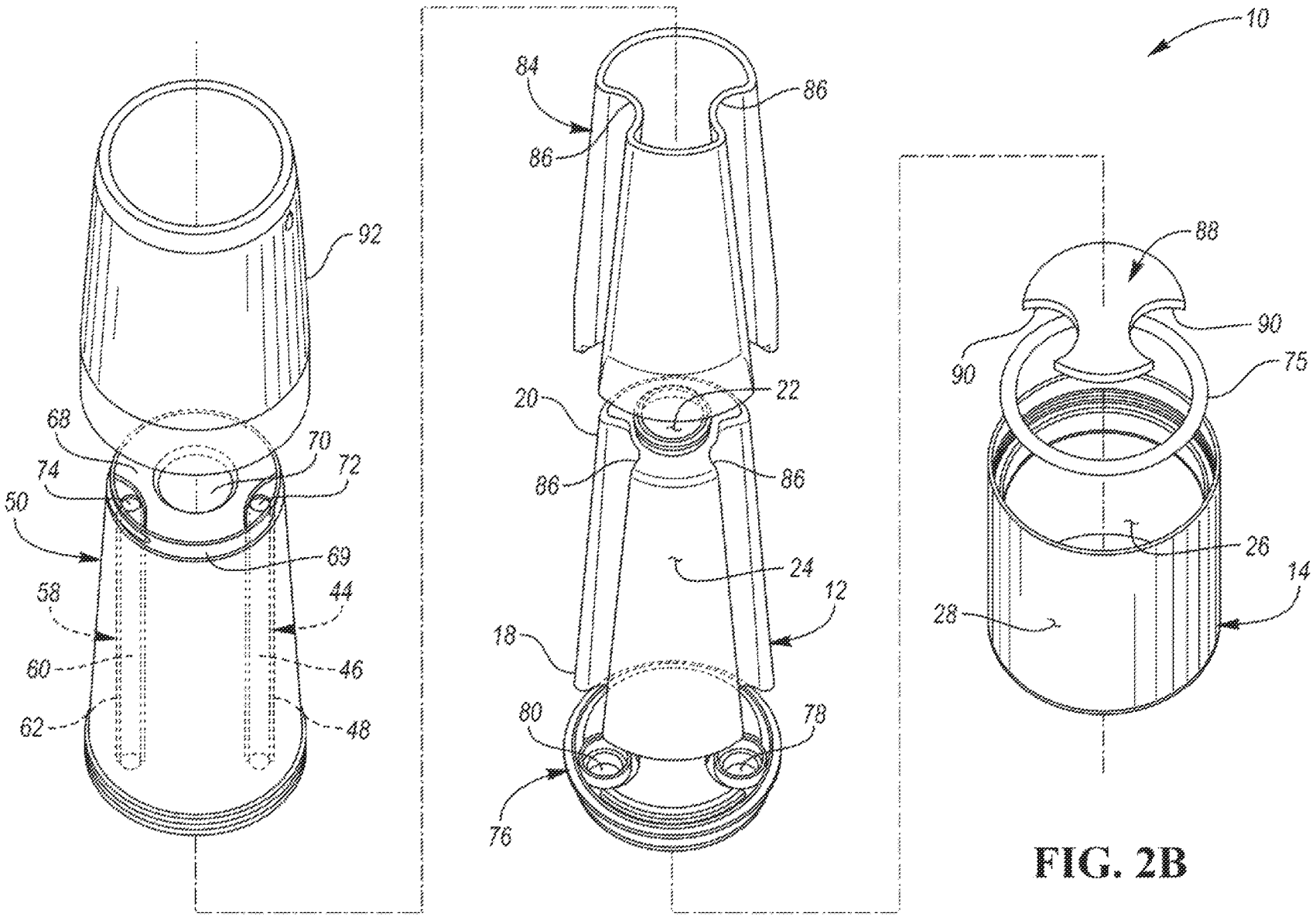
Figure 3:
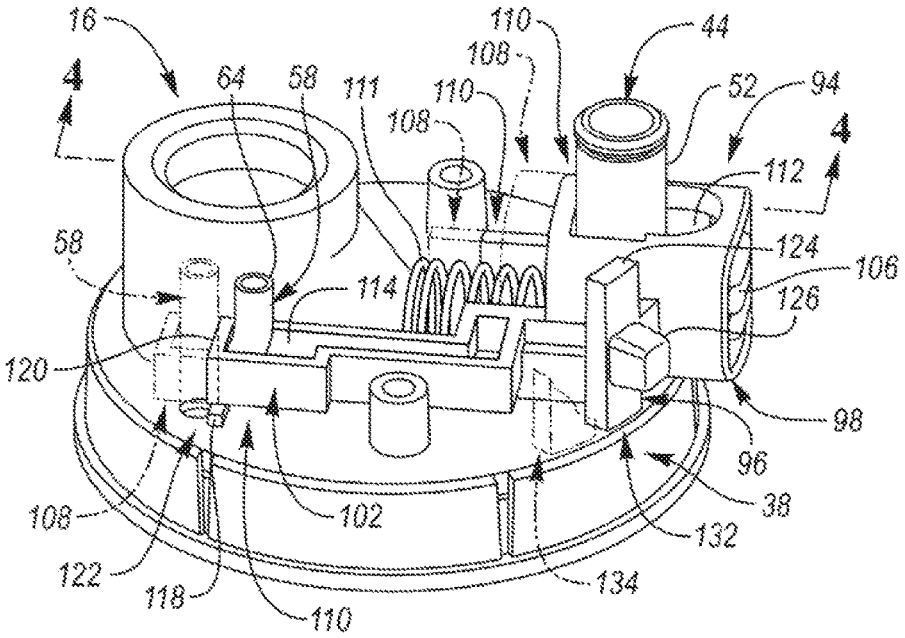
FIG. 3 is a perspective view of a cap assembly with an upper layer of the cap assembly removed.
Figure 4:
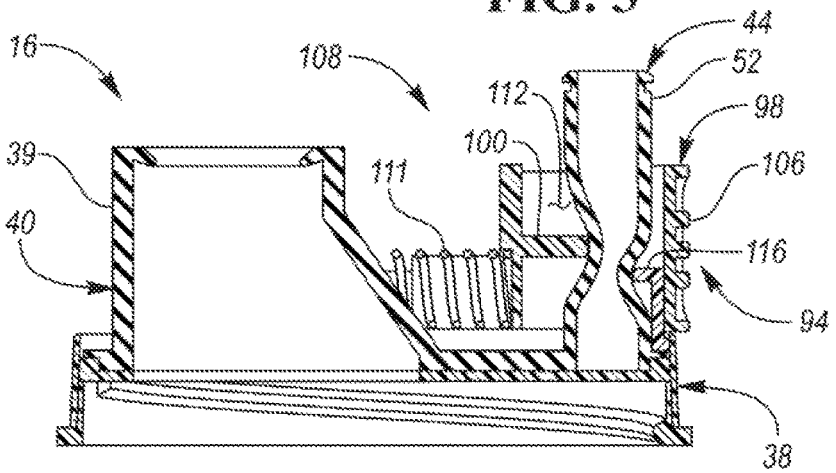
FIG. 4 is a cross-sectional view taken along line 4-4 in FIG. 3 illustrating a fluid flow restricting device in a first position.
Figure 5:
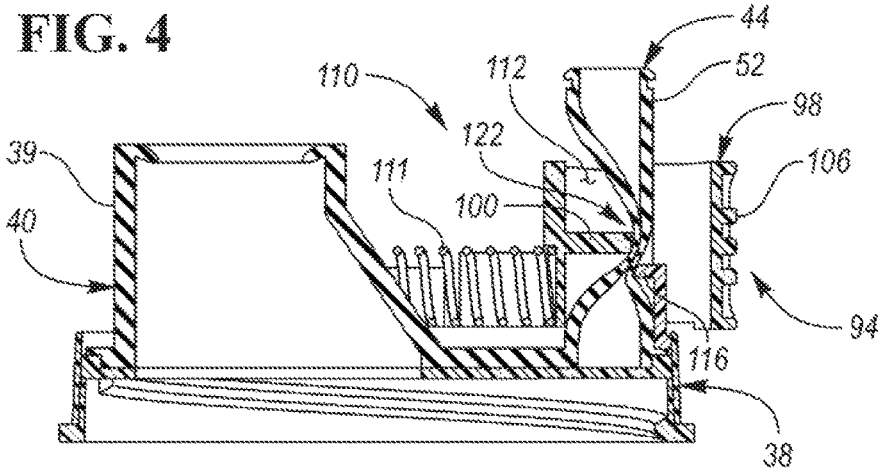
FIG. 5 is a cross-sectional view taken along line 4-4 in FIG. 3 illustrating the fluid flow restricting device in a second position.

Referring to FIGS. 2A-2B, an exploded view of the exemplary beverage container 10 is illustrated. The first vessel 12 defines a first internal cavity 22. More specifically, at least one wall 24 of the first vessel 12 defines the internal cavity 22 and forms the cylindrical, conical, or frusto-conical shape of the first vessel 12. The second vessel 14 defines a second internal cavity 26. More specifically, at least one wall 28 of the second vessel 14 defines the second internal cavity 26. The second vessel 14 may be cylindrical in shape.

The cap assembly 16 defines a first dispensing outlet or orifice 30, a second dispensing outlet or orifice 32, and a third internal cavity 34. More specifically, the third internal cavity 34 may be defined between an upper portion 36 and an intermediate portion 38 of the cap assembly 16. The cap assembly 16 is secured to an opposing side of the first vessel 12 relative to the second vessel 14 such that the first dispensing orifice 30 is in fluid communication with the first internal cavity 22 and is configured to dispense liquid from the first internal cavity 22. Fluid communication may refer to the flow of a fluid (i.e., a liquid or a gas) or the ability of a fluid to flow between distinct positions in space. More specifically, a lower portion 40 of the cap assembly 16 is secured to the opposing side of the first vessel 12 relative to the second vessel 14. The lower portion 40 of the cap assembly 16 may include an intermediate tube 39 that defines an intermediate channel 42 that establishes fluid communication between the first dispensing orifice 30 and the first internal cavity 22.

It should be noted that the lower portion 40 in FIG. 2A is shown to be positioned above the intermediate portion 38 for illustrated purposes. Once the cap assembly 16 has been assembled, the lower portion 40 will be disposed along a bottom surface 41 of the intermediate portion 38. Peripheral walls 43 of the intermediate portion 38, however, may extend below the lower portion 40 for attaching the cap assembly 16 to the remainder of the beverage container 10.

A first conduit or liquid dispensing tube 44 defines a first channel 46 that establishes fluid communication between the second dispensing orifice 32 and the second internal cavity 26. The second dispensing orifice 32 is configured to dispense liquid from the second internal cavity 26 via the liquid dispensing tube 44. The liquid dispensing tube 44 may be comprised of several subcomponents that extend from the second internal cavity 26 to the second dispensing orifice 32. For example, a first portion 48 of the liquid dispensing tube 44 may be secured to a sleeve or carrier 50 that is disposed over the first vessel 12 while a second portion 52 of the of the liquid dispensing tube 44 may extend from the lower portion 40 of the cap assembly 16. The carrier 50 may also be cylindrical, conical, or frusto-conical in shape. The intermediate portion 38 of the cap assembly 16 may define a first intermediate orifice 54 that the second portion 52 of the liquid dispensing tube 44 extends through once the cap assembly 16 has been assembled.

A second conduit or vent tube 58 defines a second channel 60 that establishes fluid communication between the cap assembly 16 and the second internal cavity 26. The vent tube 58 is configured to vent gas from the second internal cavity 26. More, specifically, the vent tube 58 may establish fluid communication between the third internal cavity 34 defined by the cap assembly 16 and the second internal cavity 26. In an alternative embodiment, the vent tube 58 may establish fluid communication between the second internal cavity 26 and a third outlet or orifice that is defined by the cap assembly 16 and is open to the surrounding ambient air, similar to the second dispensing orifice 32. Such a third outlet or orifice may be referred to as venting outlet or orifice. The vent tube 58 may be comprised of several subcomponents that extend from the second internal cavity 26 to the cap assembly 16. For example, a first portion 62 of the vent tube 58 may be secured to the carrier 50 that is disposed over the first vessel 12 while a second portion 64 of the vent tube 58 may extend from the lower portion 38 of the cap assembly 40. The intermediate portion 38 of the cap assembly 16 may define a second intermediate orifice 66 that the second portion 64 of the vent tube 58 extends through once the cap assembly 16 has been assembled. The intermediate portion 38 of the cap assembly 16 may also define a third intermediate orifice 67 that the intermediate tube 39 extends through once the cap assembly 16 has been assembled.

The cap assembly 16 (or more specifically the intermediate portion 38 of the cap assembly 16) may be indirectly secured to the second end 20 of the first vessel 12 via a top wall 68 of the carrier 50. Additionally, interior surfaces of the peripheral walls 43 of the intermediate portion 38 may be secured to exterior peripheral walls 69 of the carrier 50. The top wall 68 of the carrier 50 may be a partition wall between the first vessel 12 and the cap assembly 16 that is configured to prevent fluid communication between the first internal cavity 22 and the third internal cavity 34. The top wall 68 of the carrier 50 may also be referred to as the first partition wall. The top wall 68 of the carrier 50 may define a first intermediate orifice 70 that establishes fluid communication between the first internal cavity 22 and the intermediate channel 42 defined by the intermediate tube 39. The top wall 68 of the carrier 50 may define a second intermediate orifice 72 that establishes fluid communication between portions of the liquid dispensing tube 44 that are located within the carrier 50 (e.g., the first portion 48) and portions of the liquid dispensing tube 44 that are located in the cap assembly 16 (e.g., the second portion 52). The top wall 68 of the carrier 50 may define a third intermediate orifice 74 that establishes fluid communication between portions of the vent tube 58 that are located within the carrier 50 (e.g., the first portion 62) and portions of the vent tube 58 that are located in the cap assembly 16 (e.g., the second portion 64).

The second vessel 14 may be indirectly secured to the first end 18 of the first vessel 12 via the carrier 50. A threaded connection (i.e., a threaded outer surface and a tapped orifice) may be utilized to secure the second vessel 14 to the carrier 50. The threaded surface of the threaded connection may be a portion of the outer surface of the carrier 50 while the tapped orifice of the threaded connection may be defined by the second vessel 14, or vice versa. An O-ring 75 may be provided to prevent fluid from leaking out of the second internal cavity 26 via the threaded connection.

The liquid dispensing tube 44 and the vent tube 58, or portions thereof, may be formed within and as part of the carrier 50. More specifically, the carrier 50 may be a solid component that defines both the liquid dispensing tube 44 and the vent tube 58. The carrier 50 may be disposed over or around the first vessel 12. More specifically, the carrier 50 may be disposed over or around the first vessel 12 such that the dispensing tube 44 and the vent tube 58 extend vertically along an exterior of the first vessel 12 from the second vessel 14 to the cap assembly 16.

A second partition wall 76 may be disposed between the first vessel 12 and the second vessel 14. The second partition wall 76 may be configured to prevent fluid communication between the first internal cavity 22 and the second internal cavity 26.

The second partition wall 76 may be an integral component of the first vessel 12 (e.g., the second partition wall 76 may be the bottom wall of the first vessel 12). The second partition wall 76 may define a first intermediate orifice 78 that establishes fluid communication between the second internal cavity 26 and the liquid dispensing tube 44. The second partition wall 76 may define a second intermediate orifice 80 that establishes fluid communication between the second internal cavity 26 and the vent tube 58.

A removable top 82 may be configured to conceal the first dispensing orifice 30. The removable top 82 may be secured to the cap assembly 16 via a threaded connection. A seal may be created between the removable top 82 and the cap assembly 16 about the first dispensing orifice 30 when the removable top 82 is secured to the cap assembly 16 to prevent fluid from leaking out of the first dispensing orifice 30. The seal may include an O-ring that is made from a flexible material that is disposed along a bottom surface of the removable cap 82.

A first insulator 84 may be disposed between the first vessel 12 and the carrier 50. The first insulator 84 may also be cylindrical, conical, or frusto-conical in shape. The first insulator 84 may be made from any insulating material such as polystyrene foam. The first insulator 84 may be configured to reduce heat transfer from a fluid that is stored within the first vessel 12. The first vessel 12 and the first insulator 84 may each include indentations 86 that provide clearance for the liquid dispensing tube 44 and vent tube 58. A second insulator 88 may be disposed adjacent to the second partition wall 76. The second insulator 88 may be made from any insulating material such as polystyrene foam. The second insulator 88 may be configured to reduce heat transfer between a first fluid that is stored within the first vessel 12 and a second fluid that is stored within the second vessel 14, which is advantageous when a cold fluid is stored in one of the first and second vessels 12, 14 while a hot beverage is stored in the other of the first and second vessels 12, 14. The second insulator 88 may also include notches 90 that provide clearance for the first intermediate orifice 78 and second intermediate orifice 80 of the second partition wall such that fluid communication between the liquid dispensing tube 44 and second internal cavity 26 and fluid communication between the vent tube 58 and second internal cavity 26 is not obstructed by the second insulator 88.

A sleeve or gripping pad 92 may be disposed over the carrier 50. The gripping pad 92 may also be cylindrical, conical, or frusto-conical in shape. The gripping pad 50 may be made from any material that increases friction between the beverage container 10 and a user's hand, such as a soft plastic or rubber. The gripping pad 92 may be disposed about the carrier 50 by a dipping process, a spray-on process, an overmolding process, or any other process. If the material that comprises the gripping pad 92 is disposed about the carrier 50 in liquid form, the material is cooled and solidified after being applied to carrier 50.

Referring now to FIGS. 2A and 3-5 portion of the cap assembly 16 including a fluid flow restricting device 94 and a locking mechanism 96 for the fluid flow restricting device 94 are illustrated. The fluid flow restricting device 94 includes a slidable insert 98 that includes a first protrusion 100 and a second protrusion 102. The slidable insert 98 may be partially disposed within the third internal cavity 34 and may be restricted to linear movement along a pair of tracks 104 that protrude from the intermediate portion 38 of the cap assembly 16. The slidable insert 98 may also include a push button 106 that extends through an exterior orifice 107 defined by the upper portion 36 of the cap assembly 16. The slideable insert 98 may be configured to transition between a first position 108 (see phantom lines in FIG. 3 and see FIG. 4) and a second position 110 (see solid lines in FIG. 3 and see FIG. 5). The push button may be configured to transition the slidable insert 98 from the second position 110 to the first position 108 when depressed by a user, while a biasing element 111, such as a coil spring, may be configured to bias the slidable insert 98 into the second position 110 when the push button 106 is not being depressed.

The slidable insert 98 defines a first orifice 112. The second portion 52 of the liquid dispensing tube 44 extends through the first orifice 112 once the cap assembly 16 has been assembled. The second protrusion 102 of the slidable insert 98 defines a second orifice 114. The second portion 64 of the vent tube 58 extends through the second orifice 114 once the cap assembly 16 has been assembled. The first protrusion 100 extends into the first orifice 112. The intermediate portion 38 of the cap assembly 16 defines a first tab 116 that protrudes into the first orifice 112 opposite of and offset from the first protrusion 100. The intermediate portion 38 cap defines a second tab 118 that is positioned proximate to an end wall 120 of the second protrusion 102.

When the slidable insert 98 is in the first position 108, the first protrusion 100 and the first tab 116 interact with the second portion 52 of the liquid dispensing tube 44 to permit fluid communication through the liquid dispensing tube 44. Also, when the slidable insert 98 is in the first position 108, the second protrusion 102 (or more specifically the end wall 120 of the second protrusion 102) and the second tab 118 interact with the second portion 64 of the vent tube 58 to permit fluid communication through the vent tube 58. When the slidable insert 98 is in the second position 110, the first protrusion 100 and the first tab 116 interact with the second portion 52 of the liquid dispensing tube 44 to restrict fluid communication through the liquid dispensing tube 44. Also, when the slidable insert 98 is in the second position 110, the second protrusion 102 (or more specifically the end wall 120 of the second protrusion 102) and the second tab 118 interact with the second portion 64 of the vent tube 58 to restrict fluid communication through the vent tube 58. Restriction of fluid communication through either the liquid dispensing tube 44 or the vent tube 58 may be accomplished by creating pinch points 122 within the respective tubes. The second portion 52 of the liquid dispensing tube 44 and the second portion 64 of the vent tube 58 may each be made from a flexible material, such as a soft plastic or rubber, that permits deformation which may form fluid impermeable seal once a pinch point is formed.

The locking mechanism 96 for the fluid flow restricting device 94 may include a sliding protrusion 124 that is disposed within the third internal cavity 34. The sliding protrusion 124 may be connected to a sliding button 126 that is disposed on the exterior of the upper portion 36 of the cap assembly 16 through a slot 128 defined by the upper portion 36 of the cap assembly 16. The position of the locking mechanism 96 (including both the sliding protrusion 124 and sliding button 126) may be adjusted linearly along the slot 128 by a user engaging the sliding button 126. The fluid flow restricting device 94 may define an additional orifice or notch 130. The locking mechanism 96 may be configured to transition between an advanced position 132 (see solid lines in FIG. 3) and a retracted position 134 (see phantom lines in FIG. 3). When the locking mechanism 96 is in the advanced position 132 and the slidable insert 98 is in the second position 110, the sliding protrusion engages the notch 130 and prevents the slidable insert 98 from transition from the second position 110 to the first position 108 when a user engages the push button 106 (i.e., the locking mechanism 96 locks the slidable insert 98 in the second position 110 when the locking mechanism 96 is in the advanced position 132). When the locking mechanism 96 is in the retracted position 134, the slidable insert 98 may transition between the first position 108 and the second position 110 by activation of the push button 106.

Figure 6B:
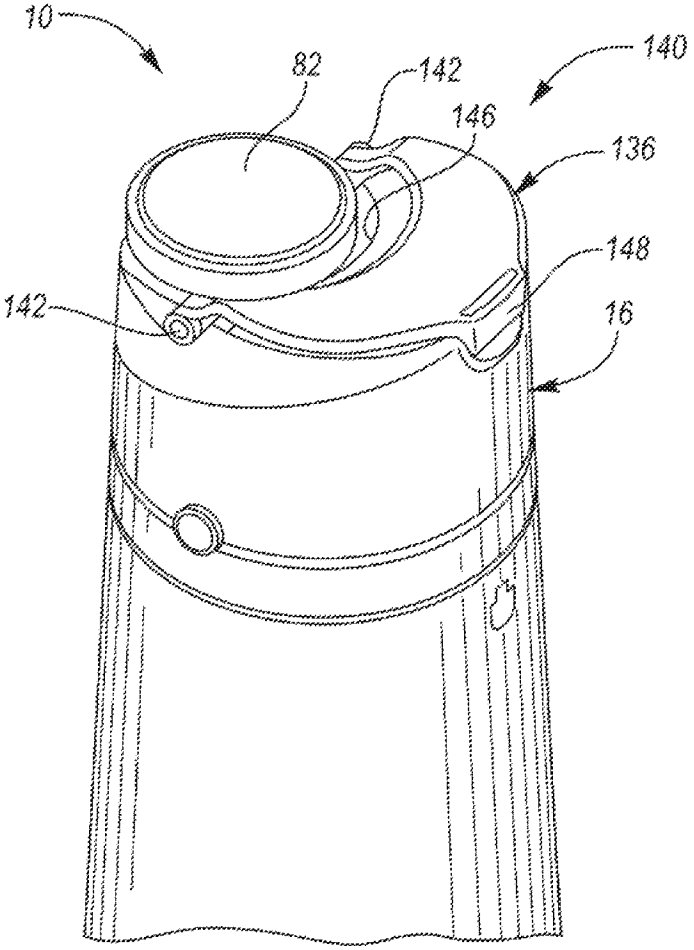
FIGS. 6A and 6B illustrate a first alternative embodiment of a fluid flow restricting device in first and second positions, respectively.
Figure 6A:
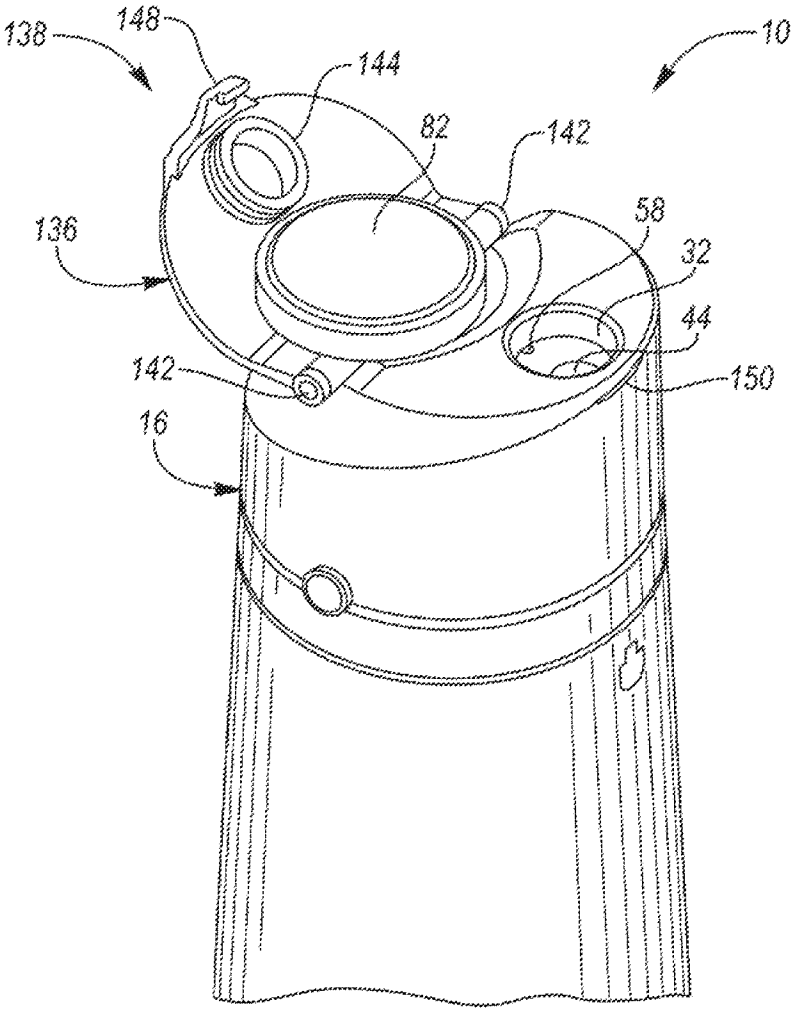
Figure 8:
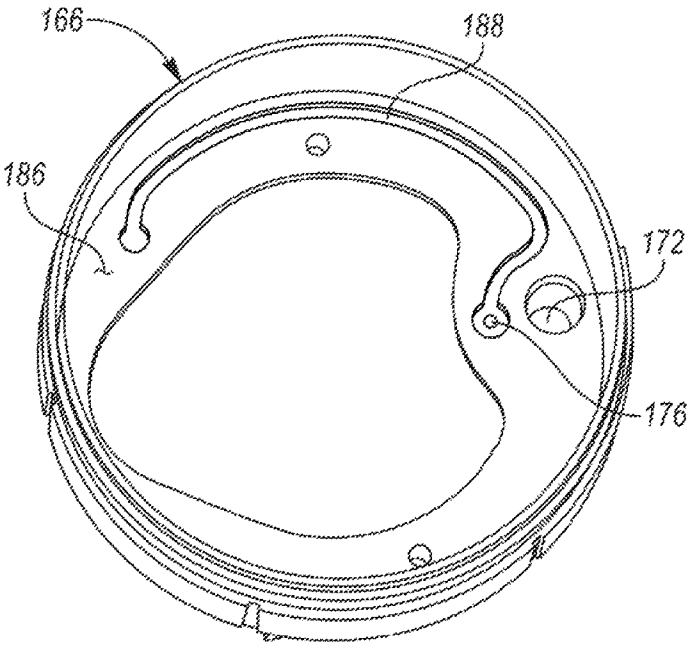
FIG. 8 is a bottom view of an intermediate portion of the alternative embodiment of the cap assembly.

Referring to FIGS. 6A and 6B, a first alternative embodiment of a fluid flow restricting device 136 is illustrated. Also in the alternative embodiment, the liquid dispensing tube 44 and the vent tube 58 are both routed directly to and in fluid communication with the second dispensing orifice 32. The second dispensing orifice 32, therefore, forms a common outlet of the liquid dispensing tube 44 and the vent tube 58 in the alternative embodiment. The fluid flow restricting device 136 is configured to transition between a first position 138 (see FIG. 6A) and a second position 140 (See FIG. 6B). The fluid flow restricting device 136 may be secured to the cap assembly 16 by a hinge 142 such that the fluid flow restricting 136 rotates between the first position 138 and the second position 140. The fluid flow restricting 136 permits fluid communication through both the liquid dispensing tube 44 and the vent tube 58 when in the first position by providing access to the common outlet (i.e., second dispensing orifice 32). The fluid flow restricting 136 restricts fluid communication through the both the liquid dispensing tube 44 and the vent tube 58 when in the second position 140 by concealing or plugging the common outlet (i.e., second dispensing orifice 32). More specifically, the fluid flow restricting device 136 includes a plug or protrusion 144 that extends into the second dispensing orifice 32 when the fluid flow restricting device 136 is in the second position 140 to restrict fluid communication through the both the liquid dispensing tube 44 and the vent tube 58. Alternatively, two plugs or protrusions may extend into the second dispensing orifice 32 when the fluid flow restricting device 136 is in the second position 140, where one of the plugs or protrusions restricts fluid communication through the liquid dispensing tube 44 while the other of the plugs or protrusions restricts fluid communication through the vent tube 58. The fluid flow restricting device 136 may include a notch 146 to prevent interference between the fluid flow restricting 136 and the removable top 82 for when the fluid flow restricting device 136 transitions between the first position 138 and second position 140.

The fluid flow restricting device 136 may also include a clip 148 that engages a notch 150 defined by the cap assembly 16 to secure the fluid flow restricting device 136 in the second position 140. The clip 148 may include a living hinge that disengages the clip 148 from the notch 150 when engaged by the user. Alternatively, a snap connection, a hook connection, a hook and loop connection (e.g., Velcro®), or any other type of connection may be utilized to secure the fluid flow restricting device 136 in the second position 140.

It should be understood that any type of fluid flow restricting device, other than fluid flow restricting device 94 and fluid flow restricting device 136, may be utilized to permit and restrict fluid flow through the liquid dispensing tube 44 and the vent tube 58. For example, spherical balls or rollers may be configured to block exit orifices from the liquid dispensing tube 44 and the vent tube 58 when in a first position and expose the exit orifices from the liquid dispensing tube 44 and the vent tube 58 when in a second position. The balls or rollers may ride along a guided surface or ramp that is a subcomponent of the cap assembly 16 that is disposed within the within the third internal cavity 34. The balls or rollers may be disposed within a retaining device that allows for linear movement, such as a tube. The balls or rollers may be biased by a device, such as a spring, into engagement with the liquid dispensing tube 44 and the vent tube 58 in order to block the exit orifices when in the first position. Another example of a fluid flow restricting device may be a rotating ring that includes surfaces or protrusions that engage the liquid dispensing tube 44 and the vent tube 58 when in a first position to restrict fluid flow therethrough. The rotating ring may also include orifices or simply disengage the liquid dispensing tube 44 and the vent tube 58 when in a second position to permit fluid flow therethrough. Tabs may be located on the sides of the rotating ring that allow a handle or tether to be added. The tabs may include orifices that engage fasteners to secure a handle or tether to the rotating ring.

Figure 7:
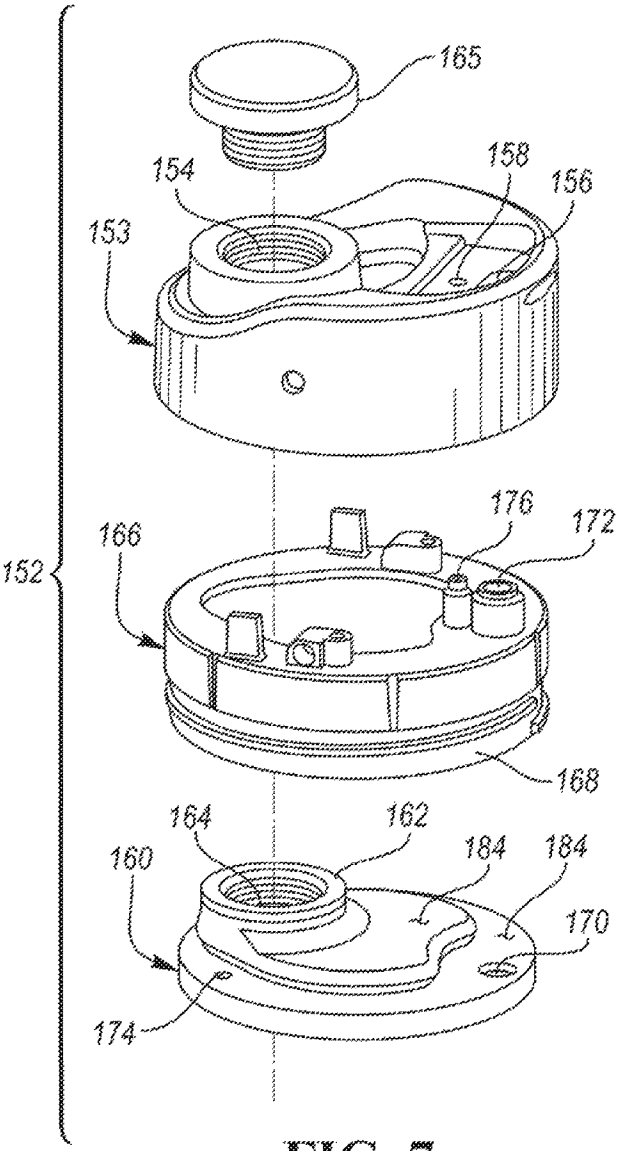
FIG. 7 is an exploded view of an alternative embodiment of the cap assembly.
Figure 9:
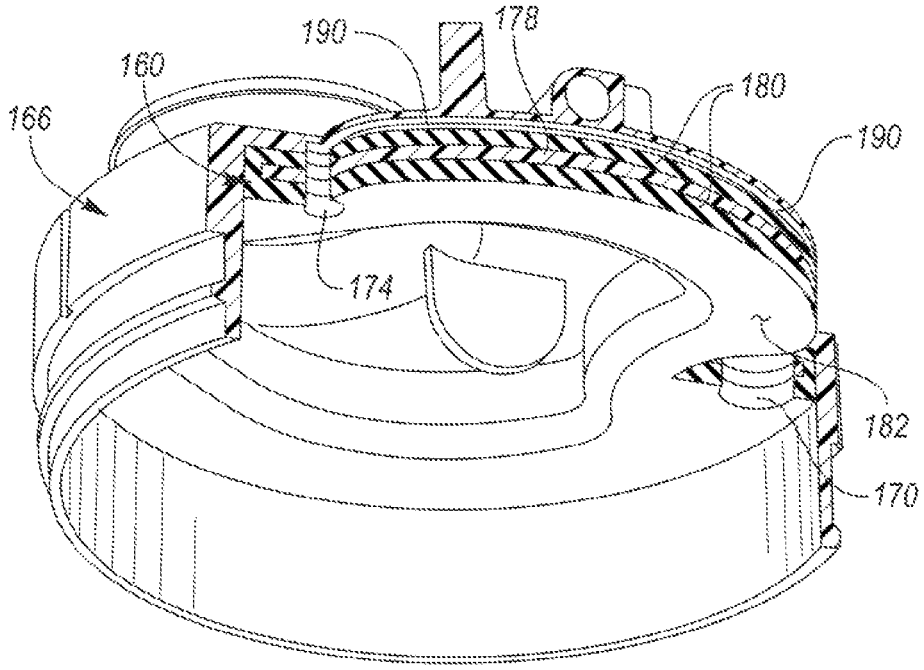
FIGS. 9 and 10 are perspective cut-away views of the alternative embodiment of the cap assembly.
Figure 10:
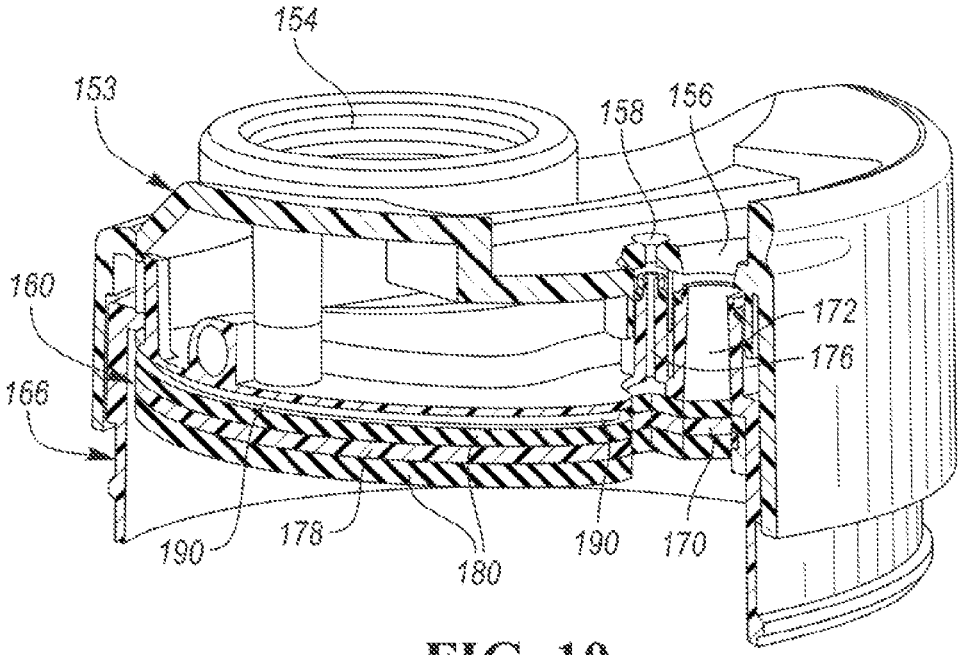

Referring to FIG. 7, an exploded view of an alternative embodiment of a cap assembly 152 is illustrated. It should be understood that FIG. 7 may replace FIG. 2A such that FIGS. 7 and 2B form a single exploded view. An upper portion 153 of the cap assembly 152 defines a first outlet or orifice 154, a second outlet or orifice 156, and a third outlet or orifice 158. The cap assembly 16 is secured to an opposing side of the first vessel 12 relative to the second vessel 14 such that the first orifice 154 is in fluid communication with the first internal cavity 22. The first orifice 154 is configured to dispense liquid from the first internal cavity 22. More specifically, a lower portion 160 of the cap assembly 152 is secured to the opposing side of the first vessel 12 relative to the second vessel 14. The lower portion 160 of the cap assembly 16 may include an intermediate tube 162 that defines an intermediate channel 164 that establishes fluid communication between the first orifice 154 and the first internal cavity 22 defined within the first vessel 12.

A removable top 165 may be configured to conceal the first orifice 154. The removable top 165 may be secured to the cap assembly 152 via a threaded connection. A seal may be created between the removable top 165 and the cap assembly 154 about the first orifice 154 when the removable top 165 is secured to the cap assembly 152 in order to prevent fluid from leaking out of the first orifice 154. The seal may include an O-ring that is made from a flexible material that is disposed along a bottom surface of the removable cap 165.

The first conduit or liquid tube 44 in the carrier 50 establishes fluid communication between the second orifice 156 and the second internal cavity 26 defined within the second vessel 14. The second orifice 156 is configured to dispense liquid from the second internal cavity 26 via the liquid dispensing tube 44. The second conduit or vent tube 58 in the carrier 50 establishes fluid communication between the third orifice 158 and the second internal cavity 26 defined within the second vessel 14. The third orifice 158 is configured to vent gas from the second internal cavity 26 via the vent tube 58.

The cap assembly 152 (or more specifically an intermediate portion 166 of the cap assembly 152) may be indirectly secured to the second end 20 of the first vessel 12 via the top wall 68 of the carrier 50. Additionally, exterior surfaces of the peripheral walls 168 of the intermediate portion 166 may be secured to interior peripheral walls of the carrier 50. More specifically, the exterior surfaces of the peripheral walls 168 may include threading that mates with threading on the interior peripheral walls of the carrier 50. Please note that external threading depicted on the exterior peripheral walls 69 of the carrier 50 in FIG. 2B may be changed to internal threading so that the second embodiment of the cap assembly 152 may mate with the carrier 50.

The first intermediate orifice 70 defined by the top wall 68 of the carrier 50 establishes fluid communication between first internal cavity 22 and the intermediate channel 164 defined by the intermediate tube 162. The second intermediate orifice 72 defined by the top wall 68 of the carrier 50 establishes fluid communication between the liquid dispensing tube 44 defined in the carrier 50 and intermediate channels (described below) that are defined within the cap assembly 152 and are in fluid communication with the second orifice 156. The third intermediate orifice 74 defined by the top wall 68 of the carrier 50 establishes fluid communication between the vent tube 58 defined in the carrier 50 and intermediate channels (described below) that are defined within the cap assembly 152 and are in fluid communication with the third orifice 158.

The lower portion 160 of the cap assembly 152 defines a first intermediate channel 170 that is in fluid communication with a second intermediate channel 172 defined by the intermediate portion 166 of the cap assembly 152. The first intermediate channel 170 and the second intermediate channel 172 establish fluid communication between the liquid dispensing tube 44 (via the second intermediate orifice 72) and the second orifice 156. The lower portion 160 of the cap assembly 152 defines a third intermediate channel 174 that is in fluid communication with a fourth intermediate channel 176 defined by the intermediate portion 166 of the cap assembly 152. The third intermediate channel 174 and the fourth intermediate channel 176 establish fluid communication between the vent tube 58 (via the third intermediate orifice 74) and the third orifice 158.

Referring now to FIGS. 7-10, the lower portion 160 of the cap assembly 152 may be comprised of a hard material layer 178 that is covered by soft material layers 180. The hard material layer 178 may be comprised of a metallic or hard plastic material while the soft material layers 180 may be comprised of a soft plastic or rubber material. The bottom surface 182 of the soft material layer 180 may provide a seal along the top wall 68 of the carrier 50 that prevents fluid communication between the first intermediate orifice 70, second intermediate orifice 72, and third intermediate orifice 74 defined by the carrier 50. The top surface 184 of the soft material layer 180 may provide a seal within the cap assembly 152 that prevents fluid communication between a first fluid circuit (that includes intermediate channel 164 and first orifice 154) and a second fluid circuit (that includes first intermediate channel 170, second intermediate channel 172, and second orifice 156).

A lower internal surface 186 of the intermediate portion 166 of the cap assembly 152 defines a groove 188. When the lower portion 160 is secured to the intermediate portion 166, the top surface 184 of the soft material layer 180 of the lower portion 160 and the lower internal surface 186 of the intermediate portion 166 define a channel 190 along the groove 188. The channel 190 may establish fluid communication between the vent tube 58 (via the third intermediate orifice 74 and the third intermediate channel 174) and the third orifice 158 (via the fourth intermediate channel 176). The channel 190 may be routed horizontally between the top surface 184 of the soft material layer 180 of the lower portion 160 and the lower internal surface 186 of the intermediate portion 166. The channel 190 may be routed along a path substantially perpendicular to the vent tube 58 and the fourth intermediate channel 176. Substantially perpendicular may refer to an incremental value that is plus or minus 15° from exactly perpendicular.

The top surface 184 of the soft material layer 180 may provide a seal within the cap assembly 152 that prevents fluid communication between a third fluid circuit (that includes third intermediate channel 174, channel 190, fourth intermediate channel 176, and third orifice 158) and the first fluid circuit (that includes intermediate channel 164, and first orifice 154). The top surface 184 of the soft material layer 180 may provide a seal within the cap assembly 152 that prevents fluid communication between the third fluid circuit (that includes third intermediate channel 174, channel 190, fourth intermediate channel 176 and third orifice 158) and the second fluid circuit (that includes first intermediate channel 170, second intermediate channel 172, and second orifice 156).

A cross-sectional area of the third orifice 158 may be smaller than a cross-sectional area of the second orifice 156 so that a liquid flowing through the second orifice 156 is less restricted than a liquid flowing through the third orifice 158. The difference in cross-sectional areas allows a liquid to easily flow from the second internal cavity 26 and through the second orifice 156 but not from the second internal cavity 26 and through the third orifice 158. Such a configuration is desirable since the second orifice 156 is utilized to dispense a liquid stored within the second internal cavity 26 while the third orifice 158 is utilized for venting air from the second internal cavity 26. For the same reasons, a cross-sectional area of the entire fluid circuit from the second internal cavity 26 to the third orifice 158 (which includes second intermediate orifice 80, vent tube 58, third intermediate orifice 74, third intermediate channel 174, channel 190, fourth intermediate channel 176, and third orifice 158) may be smaller than a cross-sectional area of the entire fluid circuit from the internal cavity 26 to the second orifice 156 (which includes first intermediate orifice 78, liquid dispensing tube 44, second intermediate orifice 72, first intermediate channel 170, second intermediate channel 172, and second orifice 156).

Figure 11A:
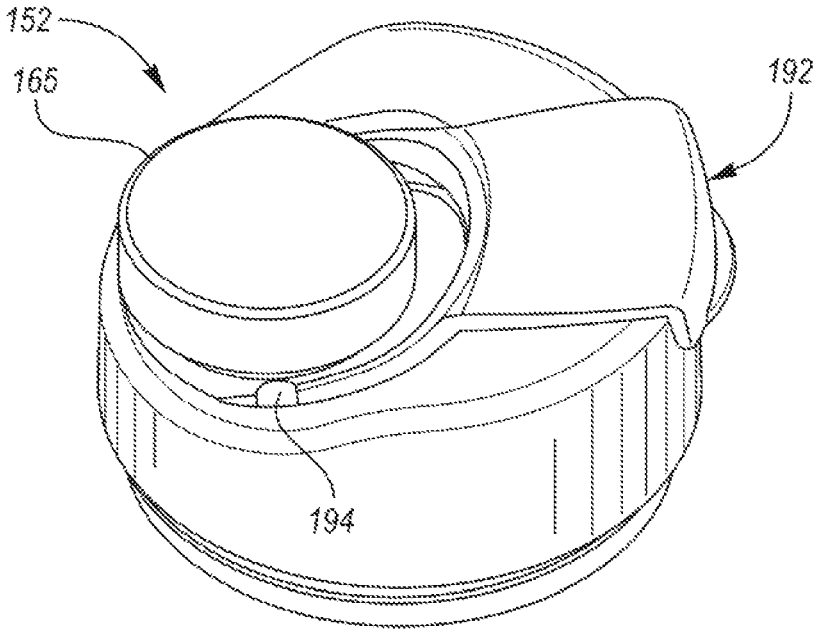
FIGS. 11A and 11B illustrate a second alternative embodiment of a fluid flow restricting device in first and second positions, respectively.
Figure 11B:
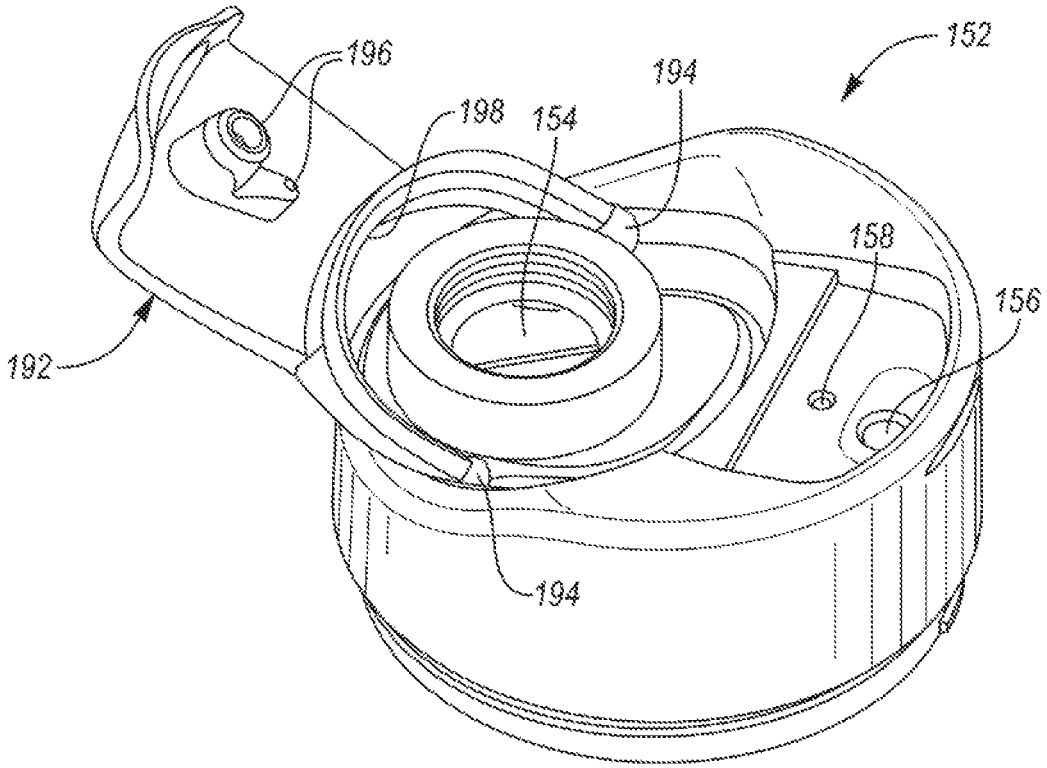

Referring to FIGS. 11A and 11B a second alternative embodiment of a fluid flow restricting device 192 in first and second positions are illustrated, respectively. The first position of the fluid flow restricting device 192 depicted in FIG. 11A may be a closed position while the second position of the fluid flow restricting device 192 depicted in FIG. 11B may be an opened position. The removable top 165 has been removed in FIG. 11B for illustrative purposes. The fluid flow restricting device 192 may be secured to the cap assembly 152 by a hinge 194 such that the fluid flow restricting device 192 rotates between the closed position and the opened position. The fluid flow restricting device 192 permits or allows liquid to flow out of the second orifice 156 from the second internal cavity 26 (through the various channels and orifices described above) when in the opened position. The fluid flow restricting device 192 also permits or allows gas to flow between the orifice 156 and the second internal cavity 26 (through the various channels and orifices described above) when in the opened position. When in the closed position, the fluid flow restricting device 192 restricts or prevents liquid from flowing out of the second orifice 156 from the second internal cavity 26 (through the various channels and orifices described above), and restricts or prevents gas from flowing between the third orifice 158 and the second internal cavity 26 (through the various channels and orifices described above). More specifically, the fluid flow restricting device 192 includes one or more protrusions or plugs 196 that engage the second orifice 156 and the third orifice 158 to restrict liquid or gas from respectively flowing therethrough. The fluid flow restricting device 192 may include a notch 198 to prevent interference between the fluid flow restricting 192 and the removable top 165 for when the fluid flow restricting device 192 transitions between the opened and closed positions.

It should be understood that the designations of first, second, third, fourth, etc. for vessels, internal cavities, orifices, partition walls, channels, or any other component described herein may be rearranged in the claims so that they are in chronological order with respect to the claims.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A beverage container comprising:

a first vessel defining a first internal cavity;

a second vessel secured to the first vessel and defining a second internal cavity;

a cap assembly defining a first orifice configured to dispense liquid, a second orifice configured to dispense liquid, and a third orifice configured to vent gas, the cap assembly secured to an opposing side of the first vessel relative to the second vessel, the first orifice establishing fluid communication with the first internal cavity;

a first tube establishing fluid communication between the second internal cavity and the second orifice; and a second tube establishing fluid communication between the second internal cavity and the third orifice, wherein the first and second tubes extend vertically along an exterior of the first vessel from the second vessel to the cap assembly, and wherein the cap assembly defines a horizontally routed channel that establishes fluid communication between the second tube and the third orifice.

2. The beverage container of claim 1 further comprising a partition wall disposed between the first and second vessels that is configured to prevent fluid communication between the first and second internal cavities.

3. The beverage container of claim 1, wherein a cross-sectional area of the third orifice is smaller than a cross-sectional area of the second orifice.

4. The beverage container of claim 1, wherein the first and second tubes are formed within a carrier that is disposed around the first vessel.

5. The beverage container of claim 1 further comprising a fluid flow restricting device secured to the cap assembly and configured to engage and disengage the second orifice and third orifice to respectively restrict and permit fluid flow through the second orifice and third orifice.

6. The beverage container of claim 5, wherein the fluid flow restricting device includes one or more plugs that engage the second orifice and third orifice to restrict fluid flow through the second orifice and third orifice.

7. A beverage container comprising:

a first and second vessels secured to each other and defining first and second cavities, respectively, wherein the first cavity is partitioned from the second cavity;

a cap assembly defining first, second, and third outlets, the cap assembly secured to an opposing side of the first vessel relative to the second vessel, the first outlet establishing fluid communication with the first internal cavity; and first and second conduits extending from the second vessel to the cap assembly along an exterior of the first vessel, the first conduit establishing fluid communication between the second cavity and the second outlet, the second conduit establishing fluid communication between the second cavity and the third outlet, wherein the first and second conduits extend along an exterior of the first vessel from the second vessel to the cap assembly, and wherein the cap assembly defines a channel that is routed along a path that is substantially perpendicular to the second conduit and establishes fluid communication between the second conduit and the third outlet.

8. The beverage container of claim 7 further comprising a partition wall disposed between the first and second vessels that is configured to prevent fluid communication between the first and second cavities.

9. The beverage container of claim 7, wherein the first and second conduits are formed within a carrier that is disposed around the first vessel.

10. The beverage container of claim 7 further comprising one or more plugs configured to engage and disengage the second and third outlets to respectively restrict and permit fluid flow through the second and third outlets.

11. A beverage container comprising:

first and second vertically stacked vessels defining first and second internal cavities, respectively, wherein the first vessel is disposed above the second vessel;

a cap assembly secured to a top of the first vessel, the cap assembly defining first, second, and third orifices, the first orifice establishing fluid communication with the first internal cavity; and a first conduit establishing fluid communication between the second internal cavity and the second orifice; and a second conduit establishing fluid communication between the second internal cavity and the third orifice, wherein the cap assembly defines a horizontally routed channel that establishes fluid communication between the second conduit and the third orifice.

12. The beverage container of claim 11, wherein the first and second conduits extend vertically along an exterior of the first vessel from the second vessel to the cap assembly.

13. The beverage container of claim 12, wherein the first and second conduits are formed within a carrier that is disposed around the first vessel.

14. The beverage container of claim 11 further comprising one or more plugs configured to engage and disengage the second and third orifices to respectively restrict and permit fluid flow through the second and third orifices.

15. The beverage container of claim 11, wherein a cross-sectional area of the second orifice is smaller than a cross-sectional area of the third orifice.

* * * * *